United States Patent [19]

Grenon

[11] Patent Number: 4,629,105

[45] Date of Patent: Dec. 16, 1986

[54] APPARATUS FOR DRIVING A TAUT RIGID WIRE BETWEEN TWO GROOVED WHEELS

[76] Inventor: René E. Grenon, 21, rue Victor Hugo, 77181 Courtry, France

[21] Appl. No.: 682,356

[22] PCT Filed: Mar. 15, 1984

[86] PCT No.: PCT/FR84/00064

§ 371 Date: Nov. 13, 1984

§ 102(e) Date: Nov. 13, 1984

[87] PCT Pub. No.: WO84/03688

PCT Pub. Date: Sep. 27, 1984

[30] Foreign Application Priority Data

Mar. 16, 1983 [FR] France ..... 83 04305

[51] Int. Cl.[4] ..... B65H 51/10

[52] U.S. Cl. ..... 226/186; 226/176; 226/190

[58] Field of Search ..... 226/90, 91, 168, 174, 226/176, 177, 181, 186, 187, 188, 190

[56] References Cited

U.S. PATENT DOCUMENTS

| | | | |
|---|---|---|---|
| 3,093,285 | 6/1963 | Leaming et al. | 226/182 |
| 3,396,888 | 8/1968 | Rygiol | 226/181 |
| 3,657,940 | 4/1972 | Wagner | 74/397 |
| 3,675,837 | 7/1972 | Gerould | 226/187 |

FOREIGN PATENT DOCUMENTS

| | | |
|---|---|---|
| 664993 | 8/1938 | Fed. Rep. of Germany . |
| 1777022 | 11/1974 | Fed. Rep. of Germany . |
| 2338583 | 5/1978 | Fed. Rep. of Germany . |
| 3021673 | 12/1981 | Fed. Rep. of Germany . |
| 625594 | 5/1977 | U.S.S.R. . |

*Primary Examiner*—Stanley N. Gilreath

*Attorney, Agent, or Firm*—Cushman, Darby & Cushman

[57] ABSTRACT

The assembly comprising the motor unit (9), the drive pulley (8), the driven pulley (6), and the grooved wheel (3) is pivotally mounted relative to the fixed position pressure wheel (2) by means of an actuator (19) whose piston (21) presses against the frame (1) under the control of a slide valve (20) whose slide (27) is servo controlled to compensate variations from a constant value (L) for the distance between the axis (10) of the motor unit (9) and the axis (11) of the driven pulley (6), whereby the pressure exerted on the wire automatically adjusts itself to the required value.

9 Claims, 3 Drawing Figures

APPARATUS FOR DRIVING A TAUT RIGID WIRE BETWEEN TWO GROOVED WHEELS

The invention relates to apparatus for longitudinally driving a rigid wire which is driven by two wheels between which it is pressed.

Apparatus of this type is already known, in particular for driving metal wires through numerous machines, for example machines for bundling various articles which are bound together by a taut metal wire which is subsequently knotted by twisting its ends together.

The wire is driven by the friction which exists between the wire and the groove of a drive wheel into which it is pressed by a pressure wheel. In order to avoid any risk of the drive wheel skidding on the wire, the wire is pressed by the pressure wheel using a force which is greater than the product of the drive-resisting force multiplied by the coefficient of friction of the wire in the groove of the drive wheel. Since the drive-resisting force is variable, its maximum expected value is used for establishing the force to be applied by the pressure wheel. As a result the apparatus frequently operates with too much pressure wheel force, thereby reducing efficiency and causing more rapid wear of the parts.

The main aim of the invention is to provide apparatus for driving a taut rigid wire between two wheels in which the pressing force exerted by the pressure wheel is constantly maintained at the necessary value for properly driving the wire.

Apparatus for driving a rigid wire comprises a pressure wheel mounted to rotate freely on a frame; a driven wheel locked to rotate with a grooved wheel co-operating with the pressure wheel is mounted to rotate freely on the same frame, a motor unit including a drive pulley is supported by the frame, a belt connects the drive pulley and the driven pulley of the grooved wheel, a resilient member exerts a force on the pivot arm tending to bring the grooved wheel closer to the pressure wheel in correspondance with a minimum value of the pressing force exerted by the pressure wheel on the grooved wheel.

In accordance with the invention, the driven pulley and the grooved wheel are mounted on a arm pivoting freely relative the frame, and the motor unit is supported by a parallelogram articulated relative to the same frame. In addition, an actuator is disposed between the motor unit and a fixed point of the frame to act to move the pressure wheel and the grooved wheel closer together and further apart. The pressure chamber of this actuator is connected via a channel to a slide valve which is connected to a hydraulic circuit for fluid under low pressure and to a hydraulic circuit for fluid under high pressure. A slide mounted in the slide valve is capable of occupying a first end position putting the actuator in communication with the low pressure fluid circuit, a second end position putting the actuator in comunication with the high pressure fluid circuit, and a neutral intermediate position isolating the actuator from both of the circuits. The slide is urged form one of ends by a relatively weak constant force pressing its opposite end against the axis on which the driven pulley is mounted.

In an equilibrium operating position of the assembly, for driving a wire of given diameter between the wheels, the slide is pressed against the axis of the driven pulley while being in its neutral intermediate position. In this state the pressure of the fluid in the actuator chamber is the pressure which corresponds to the just sufficient belt tension for suitably clamping the driven wire between the grooved wheel and the pressure wheel.

Any variation in the diameter of the wire corresponds to a a relative displacement of the grooved wheel relative to the pressure wheel, together with a displacement of the slide in the slide valve towards one of its end positions. As a result, the actuator receives or looses fluid and the motor unit moves relative to the frame until the slide returns to its neutral intermediate position. Thus, the assembly comprising the motor unit, the driven pulley and the grooved wheel is moved relative to the frame, and thus relative to the pressure wheel, while the distance between the axes of the drive pulley and the driven pulley remains at a constant value.

In accordance with a further improvement, means are incorporated in apparatus in accordance with the invention to count the number of revolutions of the grooved wheel. These means may be disposed on the grooved wheel itself, or on any other part rotating at a constant ratio therewith. The signals supplied by these counting means are useful for monitoring any faulty operation: accidental jamming of the apparatus, the wire coming out of its guide, etc.; and for more accurate control of its operation, eg. slowing down before the predetermined end of the wire, as well as for monitoring wear and triggering various maintenance operations.

There follows a description of an embodiment which is given without any limiting intention and without excluding any variants. Reference is made to the accompanying drawings, in which.

Figure 1:
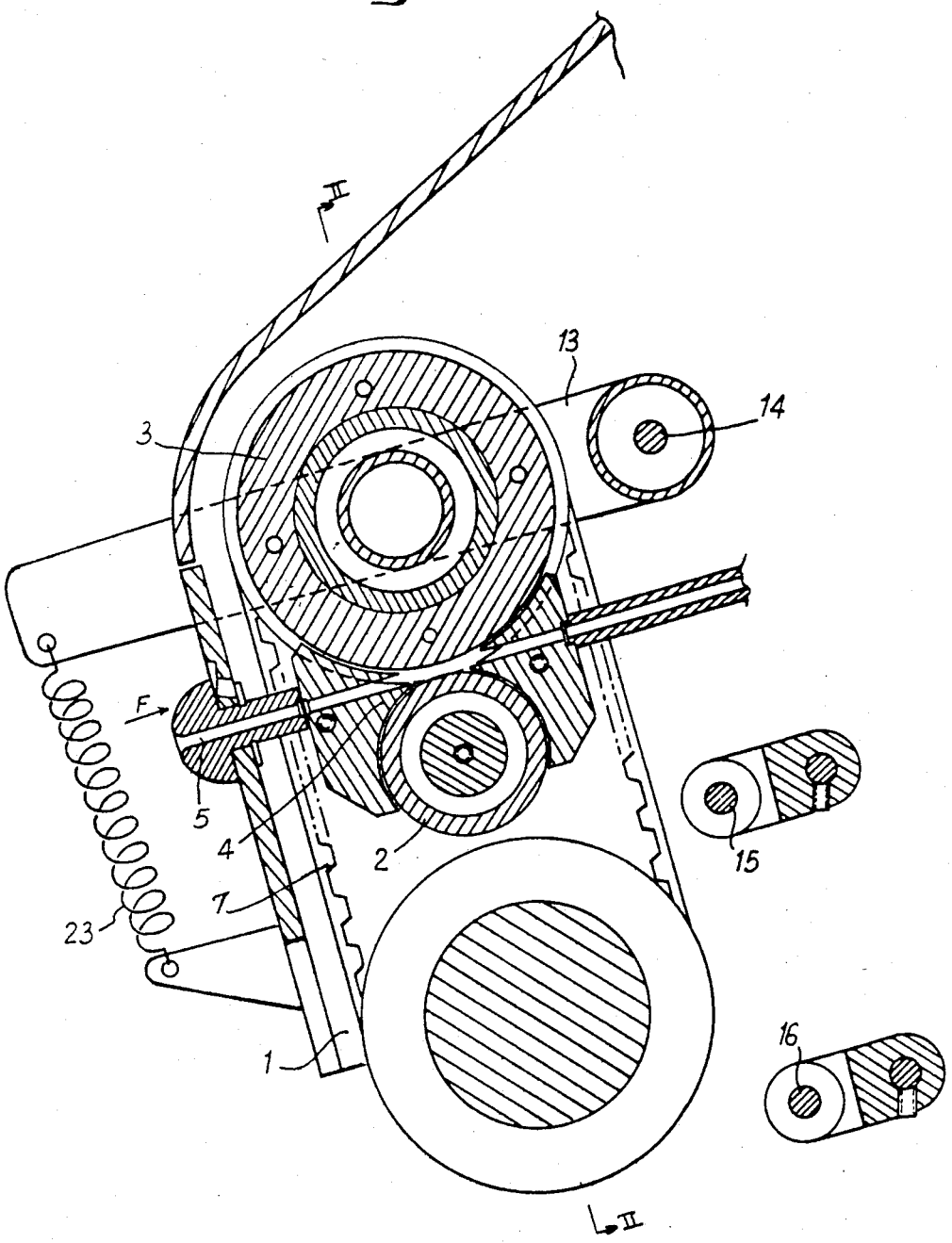
FIG. 1 is a section on a plane passing through the axis of the driven wire and the mid planes of the pressure wheel and the grooved wheel of wire driving apparatus in accordance with the invention.

The apparatus in accordance with the invention includes conventional components which it is not necessary to describe in detail. On a general frame 1, a pressure wheel 2 is mounted free to rotate at a fixed point. To drive a rigid wire, this wheel co-operates with a grooved wheel 3 on a portion 4 of the path 5 of the wire which is to be thrust in the directin of an arrow F in FIG. 1. The grooved wheel 3 is locked to rotate with a driven pulley 6 which is coupled by a toothed belt 7 or chain to a drive pulley 8 which is itself lock to rotate with the shaft of a motor unit 9. The motor unit 9 and the drive pulley 8 have a common geometrical axis 10. The driven pulley 6 and the grooved wheel 3 have a common geometrical axis 11. The distance between these axes 10, 11 is L which corresponds to the normal operating tension of the belt 7.

In accordance with the invention, the driven pulley 6 and the grooved wheel 3 are mounted free to rotate about a shaft 12 (coaxial with the geometric axis 11), which is itself mounted on an arm 13 which is free to pivot at 14 relative to the frame 1. The motor unit 9 and the drive pulley 8 are supported by two arms of an articulated parallelogram which is free to pivot at 15 and 16 relative to the frame 1. Consequently, the assembly comprising the motor unit 9, the drive pulley 8, the driven pulley 9 and the grooved wheel 3 is capable of rotating relative to the fixed position pressure wheel 2 without changing the distance L between the geometrical axes 10 and 11, (apart from small variations due to operating play, parts bending, and to the small degree of elasticity of the belt 7).

The arm 13 on which the shaft 12 of the grooved wheel 3 is mounted also supports a lateral extension 17 which is preferably in line with the shaft 12 and parallel to the motor unit 9. A body 18 is fixed to the motor unit in the direction of the lateral extension 17, the body 18 being common to an actuator 19 and to a slide valve 20.

The actuator 19 is of the single action type: it has a piston 21 which extends therefrom away from a pressure chamber 22 to press against the frame 1. The pressure chamber is on the motor unit side thereof. Clearly, any increase in the pressure developed in the actuator chamber 19 causes the assembly comprising the motor unit 9, the pulleys 8 and 6, and the grooved wheel 3 to move closer to the pressure wheel 2. Conversely, any reduction in the pressure in the chamber 22 of the actuator 19 enables the same assembly to move the grooved wheel 3 away from the pressure wheel 2. Any constant pressure, at any given value, of the fluid inside the chamber 22 of the actuator 19 opposes any increase in the gap between the grooved wheel 3 and the pressure wheel 2. This constant pressure value may be zero. Any increase in the gap is made impossible, except for the amount possible due to operating play, fluid leaks, and the "compressibility" of the fluid, (even when the hydraulic fluid is theoretically incompressible).

The value of the constant pressure in the actuator 19 determines the force with which the two wheels 3 and 2 are pressed against each other, when empty and without a wire in between them. If a low value pressure is chosen which is incapable of providing the necessary force, then, for reasons which appear below, the two wheels 2 and 3 are kept in contact by means of a traction spring 23 which is disposed for example, between the frame 1 and the free end of the arm 13 which extends beyond the shaft 12 of the driven pulley 6.

The chamber 22 of the actuator 19 communicates via a T-shaped channel 24 through the piston 21 with a corresponding channel 25 in the slide valve 20 and leading to an internal volume 26. A slide 27 passes therethrough (see FIG. 3) having an end portion 28 acting as a piston in an actuator 29 in such a manner that the other end 30 thereof is kept constantly pressed the free end of an adjusting screw 31. The adjusting screw 31 is screwed in the lateral extension 17 and towards the motor unit 9.

A channel 32 having low pressure fluid and a channel 33 having high pressure fluid open out into respective opposite ends of the internal volume 26. The channel 33 is fed from piping 34 which is also connected via a channel 35 to the actuator 29.

Figure 2:
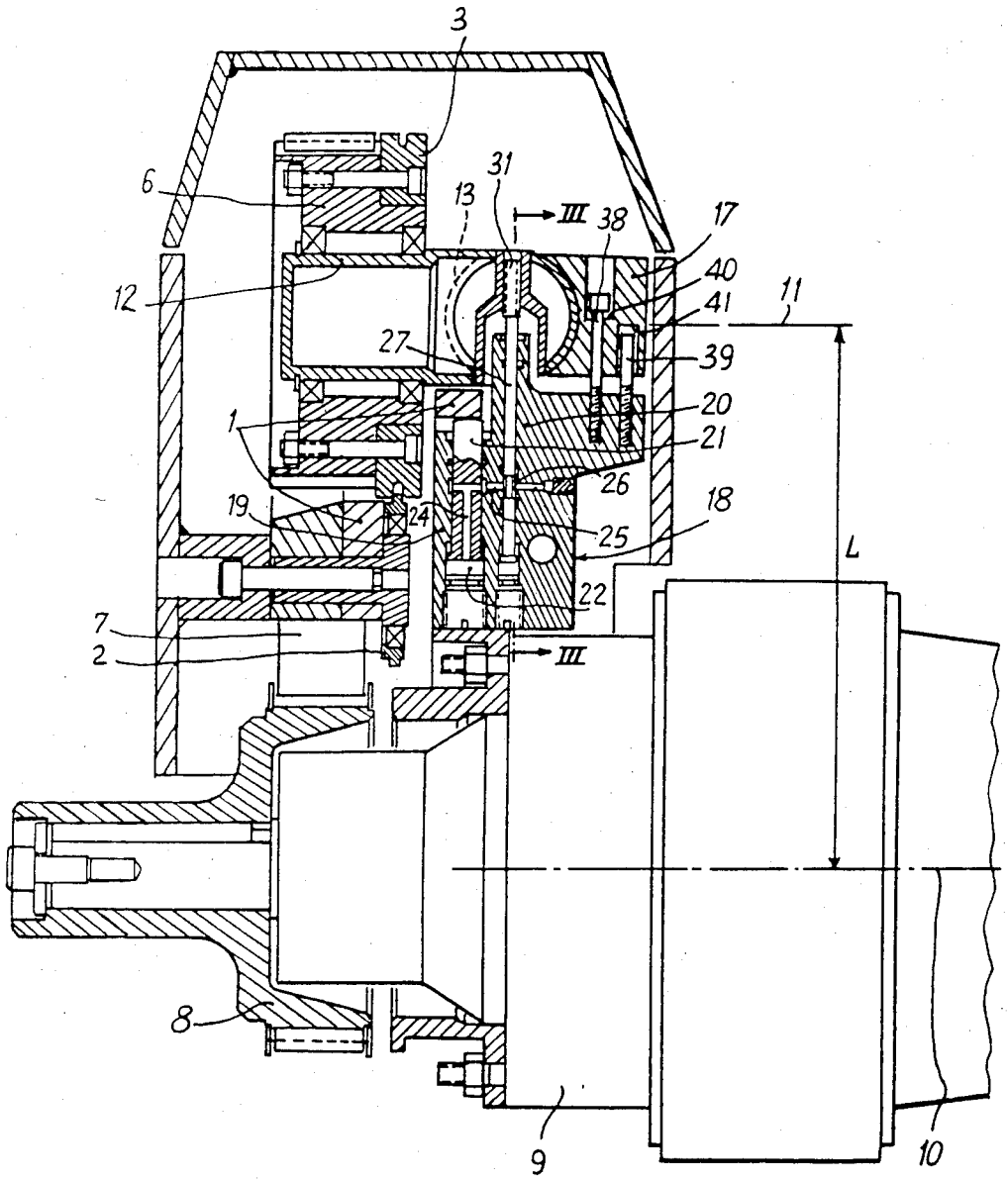
FIG. 2 is a section on a line II—II of FIG. 1.
Figure 3:
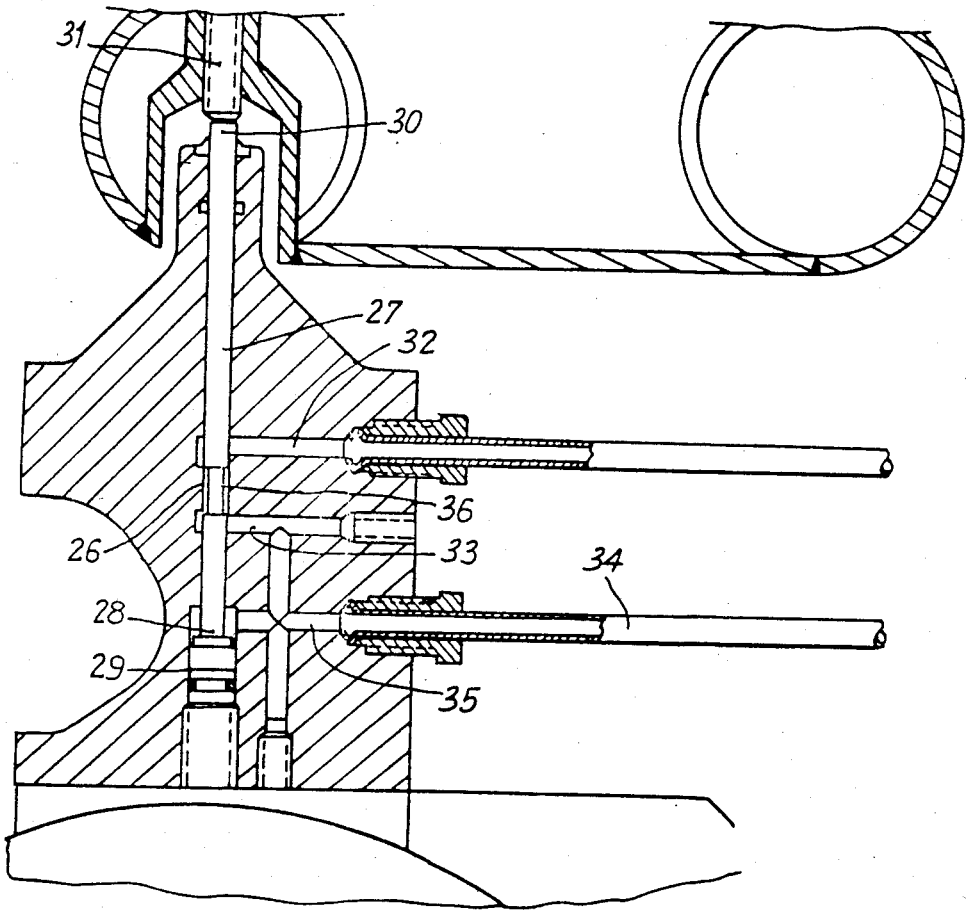
FIG. 3 is a section on a line III—III of FIG. 2.

In the middle of the slide between the channels 32 and 33, there is a waist portion of reduced diameter 36. This portion may occupy three different positions: in a first end position it opens the channel 32 and enables fluid in the pressure chamber 22 of the actuator 19 to pass from the channel 25 into the channel 32 via the T-shaped channel 24; in a second end position, the slide 27 opens the channel 33 and enables fluid under pressure to pass from the channel 33 to the channel 25 and thence into the pressure chamber 22 of the actuator 19; and in an intermediate or neutral position, as shown in FIGS. 2 and 3, the slide 27 closes both channels 32 and 33, thereby isolating the chamber 22 of the actuator 19 therefrom.

The apparatus in accordance with the invention operates as follows.

The adjusting screw 31 is used to make adjustments as a function of the chosen constant pressure in the pressure chamber 22 of the actuator 19 in such a manner that the distance L between the axes is at its normal value and the slide 27 is in its neutral position. At rest the spring 23 applies the wheels 2 and 3 against each other with a force that may be rather low so that it is easy to insert a wire between them by pushing it by hand.

Once the wire is engaged between the wheels 2 and 3, or later on when a wire which is already inserted increases in diameter, the traction created by the grooved wheel 3 and the belt 7 increases and the moving assembly as defined above is forced to move to increase the distance between the wheels 2 and 3. As soon as this movement begins, the slide 27 which was stopped by pressing against the screw 31 against which it is pushed by the actuator 29 moves relatively towards its first end position. As a result the actuator 19 is put into communication with the channel 32 thus rapidly loosing its fluid. This enables the current displacement to continue until he neutral position of the slide 27 is regained. The fluid in the chamber 22 blocks them moving assembly against retreat corresponding to the gap between the wheels 2 and 3.

If the engaged wire decreases in diameter, the tension exerted by the belt 7 tends to drop off while at the same time drawing the wheel 3 closer to the wheel 2, corresponding to a displacement of the moving assembly during which the slide 27 is displaced relatively towards its second extreme position since it is stopped by the screw 31 against which it is pressed by its actuator 29. It thus puts the chamber 22 of the actuator 19 into communication with the channel 33 and the high pressure circuit such that the piston 21 remains applied against the frame 1 and that the pressurized fluid contributes to the displacement taking place. This movement is interrupted when the slide 27 is again in its neutral position. In other words, the slide 27 is moved from its intermediate or neutral position each time the distance L between the geometric axes 10 and 11 tends to change value. The movement is in such a direction as to provide corrective action to the fluid contained in the actuator 19. The actuator 19 then acts to reestablish the distance L between the axes.

It may be observed that the weight of the motor unit 9 has no effect: it is negligible in comparison with the tractive force exerted by the belt 7. The apparatus can thus operate in any position. The direction of rotation of the wheels 2 and 3 has no influence either on the equilibrium state of the apparatus, so the apparatus operates in the same way both for forwards and for reverse movement of the driven wire. The thrust of the piston 21 against the frame 1 is automatically set up in direct proportion to the dynamic tension of the belt while the distance between the axes remains constant since the equilibrium position of the piston 21 in the moving assembly is always the same.

It is often useful to ensure that the relative displacement of the motor unit 9 relative to the drive pulley 6 remains in both directions within admissible values for the distance L between the axes. In which case, two stop screws 38 and 39 are mounted on the body 18 of the actuator 19 and the slide valve 20. These screws are disposed to co-operate in opposite directions with corresponding stop faces 40 and 41 provided on the lateral extension 17 of the shaft 12.

Since the position adjustment automatically sets up the necessary value, the parts of the apparatus are not subjected to uselessly large stresses, and there is no danger of skidding. As a result, it is possible and advantageous, in the context of the invention to incorporate means for counting the revolutions of the grooved wheel of of some other part rotating therewith such as the motor unit 9. These means may be of any type known per se. They provide considerable advantages in the use of apparatus in accordance with the invention. For a given diameter of driven wire, the length of wire actually driven corresponds to a determined number of revolutions of the grooved wheel 3. It is thus possible to check thelength of the wire supplied by the apparatus. It is also possible to ensure that the system is slowed down before coming completely to rest in order to obtain a more accurate length measurement. Further, wear in the groove of the wheel 3 means that more revolutions are required for the same length of wire. Consequently, the number of revolutions required for the same repeated operation (on average to avoid accidental causes of variation) gives a measure of the wear and may be used to trigger maintenance of the apparatus or of units of some other machine fed thereby and in which wear progressively causes an increasing length of wire to be used.

The example described above may be modified or varied in several ways without going beyond the scope of the invention. For example, the slide 27 of the slide valve 20 may be urged by a spring rather than by the actuator 29. In this case, its position could more easily be reversed with its end 30 being pressed against the motor unit 9 and the spring being interposed between the extension 17 and the slide 27. The actuator 19 could be a double-acting type of actuator in which case it would need to be fed from a slide valve suitable for performing the function described above.

I claim:

1. Apparatus for driving rigid wire and comprising:

a frame (1), a pressure wheel (2) mounted on said frame (1) to rotate freely, an arm (13) mounted on said frame (1) to pivot freely and having a shaft (12), a grooved wheel (3) mounted on said arm (13) about said shaft (12) for cooperating with said pressure wheel (2) for driving said rigid wire, a driven pulley (6) having a geometrical axis (11) mounted on said shaft (12) and locked to rotate with said grooved wheel (3), a motor unit (9) having a drive pulley (8) and a geometrical axis (10) mounted on said frame (1) and a fixed part, a belt (7) connecting said drive pulley (8) with said driven pulley (6), a resilient member (23) tending to press said two wheels (2, 3) against each other, said apparatus including an articulated member pivotably mounted on said apparatus so as to be freely pivotable relative to said frame, said motor unit being mounted on said articulated member, said apparatus further including actuator means comprising a piston slideably disposed in a cylinder with said piston being movable between said frame and said fixed part of said motor unit so that said piston will cause said wheels to be moved towards and away from each other, said actuator means including a flow passage connecting said piston to a slide valve having a slide which is movable between at least a first position where said valve is connected to a low pressure hydraulic fluid circuit and a second position where said valve is connected to a high pressure hydraulic fluid circuit, said slide having one end in constant engagement with said arm so that the position of said slide is determined by the relative distance between said geometrical axis of said driven pulley and said drive pulley.

2. The apparatus as claimed in claim 1 wherein said arm (13) includes a lateral extension on which is mounted said driven pulley and said grooved wheel, said slide valve being interposed between said motor unit and said lateral extension, said slide having an end portion which is constantly urged into contact with one of said motor units and said lateral extension.

3. The apparatus as claimed in claim 1 wherein said lateral extension is an extension of said shaft of said grooved wheel and an adjusting screw is provided, said adjusting screw being screwed into said lateral extension and having an end in contact with said slide.

4. The apparatus as claimed in claim 1 wherein said actuator means has a pressure chamber and said slide is movable to a neutral position wherein said pressure chamber is closed and said piston is held against said frame whereby movement of said wheels away from each other is opposed.

5. The apparatus as claimed in claim 4 wherein said pressure chamber, when closed, contains fluid under a pressure sufficient to result in the pressing of said wheels against each other in the absence of a wire therebetween.

6. The apparatus as claimed in claim 4 wherein said resilient member is a spring means acting between said frame and said arm and urging said arm to move in a direction to move said wheels together.

7. The apparatus as claimed in claim 4 wherein said first position of said slide is disposed on one side of said neutral position and said second position is disposed on a side opposite said one side and means are provided for moving said slide towards said second position when said grooved wheel moves towards said pressure wheel which movement corresponds to a decrease in the distance between said axes and for moving said slide toward said first position when said wheels move apart.

8. The apparatus as claimed in claim 7 wherein said slide has an end opposite said one end and said moving means is an adjusting screw having an end thereof in contact with said one end of said slide, the opposite end of said slide constituting at least a portion of said actuator means.

9. The apparatus as claimed in claim 1 wherein a revolution counting means is provided for counting the revolutions of said grooved wheel.

* * * * *